United States Patent [19]

MacDermott

[11] Patent Number: 4,672,857

[45] Date of Patent: Jun. 16, 1987

[54] LIQUID MICRODISPENSER

[75] Inventor: Bruce R. MacDermott, Berkeley, Calif.

[73] Assignee: Labindustries, Inc., Berkeley, Calif.

[21] Appl. No.: 774,531

[22] Filed: Sep. 10, 1985

[51] Int. Cl.[4] ..... B01L 3/02

[52] U.S. Cl. ..... 73/864.18

[58] Field of Search ..... 73/864.01, 864.11, 864.13, 73/864.14, 864.16, 864.18

[56] References Cited

U.S. PATENT DOCUMENTS

| | | | |
|---|---|---|---|
| 3,810,391 | 5/1974 | Suovaniemi | 73/864.18 |
| 3,827,305 | 8/1974 | Gilson et al. | 73/864.18 |
| 3,853,012 | 12/1984 | Scordato et al. | 73/864.14 |
| 4,362,064 | 12/1982 | d'Autry | 73/864.13 |
| 4,418,580 | 12/1983 | Satchell et al. | 73/864.14 |
| 4,501,163 | 2/1985 | MacDermott et al. | 73/864.18 |

*Primary Examiner*—Stewart J. Levy
*Assistant Examiner*—Robert R. Raevis
*Attorney, Agent, or Firm*—Browdy and Neimark

[57] ABSTRACT

A pipet for dispensing liquids comprises a handle with a central bore, an operating shaft supported in the upper end of the handle for sliding movement in the bore, a rod supported coaxially within the bore for reciprocal movement along the handle axis and selectively coupled to the operating shaft when the shaft is moved downwardly in the bore, and a dispensing tip having a passage therethrough and a plunger supported for reciprocal movement in the passage.

10 Claims, 9 Drawing Figures

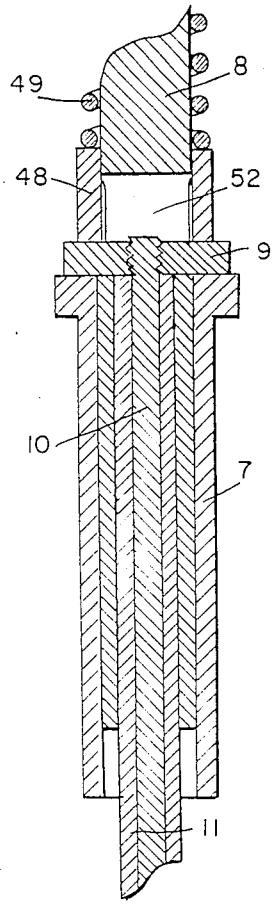
FIG. 6
FIG. 7
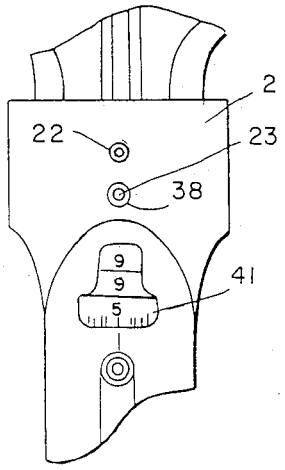
FIG. 9
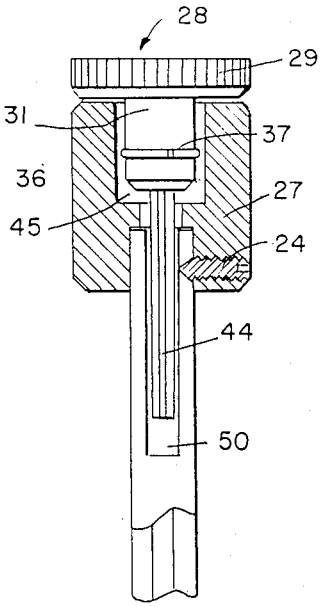
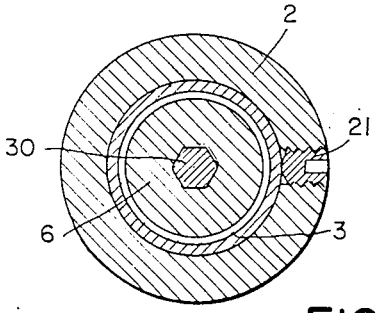
FIG. 8

LIQUID MICRODISPENSER

FIELD OF THE INVENTION

This invention relates to a syringe-type dispensers, and more particularly to a positive-displacement microdispenser adapted for snap-off engagement with precision bore tips, each including an intake and dispensing conduit and employing a wiping-contact plunger in the conduit whose travel is adjustably limited to deliver an accurately present volume.

BACKGROUND OF THE INVENTION

Various liquid micro-dispensers, or pipets, known in the prior art suffer disadvantages which the present invention overcomes.

For example, U.S. Pat. No. 4,418,580 to Stachell et al discloses a dispenser which includes a hollow tip adapted for the attachable connection to the dispensing end of the dispenser, a piston member slidably disposed within the tip, a plunger for selective engagement with the piston member, and an ejector for rapid removal of the tip and the piston without the user contacting these components.

However, with the Satchell et al dispenser, the ejecting conical member 126 is fixed relative to the tip-and-piston assembly 32 during the tip ejecting procedure. Thus, the piston 36 is restricted to a fixed location in the dispensing tip in order to facilitate its detachment during the ejection procedure.

Further, the eject mechanism requires the use of an additional device (a side button) to lock the plunger shaft in an extended, full volume position.

Moreover, no mechanism is provided for permitting the user to adjust the dispensing volume since volume settings are fixed when the unit is assembled, and no mechanism is provided for volume calibration of the instrument if it were possible to use tips having different volumes with the patented pipet. Since each instrument is designed and pre-calibrated for a given volume to be dispensed from a given tip, it does not appear that the patentees contemplated using more than one size tip to fit any given instrument.

Also known in the prior art in U.S. Pat. No. 4,362,064 to d'Autry which discloses a high-precision positive-displacement pipet having a nozzle with calibrated capillary channel means capable of being removably engaged with the free lower end of a pipet body. The dispenser of the d'Autry patent employs an entirely different mechanism for ejection of the nozzle which consists of a gripping device 32 having resilient arms 34 which engage a shouldered gripping element 16 at the upper end of a piston 18. By way of this structural relationship, there is provided an external engagement of the plunger shaft with the piston located within the nozzle.

However, the d'Autry patent has the disadvantage that no provision is made for automatic calibration of the dispensing nozzle (tip) and piston. Minor variations in length of the tip and the piston, generally exhibited with molded parts, and especially molded parts which are made of plastic and which may be subjected to sterilization in a steam autoclave and therefore are subject to shrinkage, are not accommodated by the d'Autry dispenser because the piston 18 always engages gripping device 32 against the shoulder of gripping element 16. The total length of the plunger (controller rod 24) and the piston are not adjustable during installation of the piston, and thus tip-to-tip errors can occur due to molding tolerances.

Still other conventional pipet-type dispensing devices are known. For example, U.S. Pat. No. 4,023,716 to Shapiro discloses the disengagement of a dispensing tip from its snap-fit connection in response to axial force imparted by a user to a plunger. U.S. Pat. No. 3,918,306 to Maltby discloses the disengagement only of a tip portion of a pipet-type dispensing mechanism. U.S. Pat. No. 3,760,639 to Sokol et al shows a disposable tip and piston. All of these additional related patents suffer from the same deficiencies and disadvantages discussed above in relation to the d'Autry and Satchell et al patents.

OBJECTS OF THE PRESENT INVENTION

It is therefore an object of the present invention to provide for improved and more accurate microdispensing of liquid portions.

Another object of the invention is to provide an improved liquid microdispenser which employs a precision disposable tip and plunger, as a set, which are precisely attached and positioned with a straight line motion and which are easily and simply detached, as desired, by the continued forward motion of the plunger after the desired volume has been delivered.

A further object of the invention is to provide an improved liquid microdispenser which can be calibrated independently of the dispensing tip, which requires no external setting-gauge for calibration, and which carries its own calibration adjusting tool, thus allowing precise setting of the plunger travel.

A still further object of the invention is to provide an improved liquid microdispenser which is simple in construction, which is easy to operate, which does not use fragile and hazardous glass tips, which is easily set and locked to a desired volume to provide a high degree of dispensing accuracy, and which utilizes a conveniently located, easily read digital counter to display the desired volume.

BRIEF DESCRIPTION OF THE DRAWINGS

Further objects and advantages of the invention will become apparent from the following detailed description of a specific embodiment as illustrated in the accompanying drawings, wherein:

FIG. 6 is a cross-sectional view of FIG. 5 taken along section lines 6—6 in FIG. 5;

FIG. 7 is a fragmentary elevational view showing the volume display, the volume adjustment lock set screw access hole and the calibration set screw of the inventive apparatus;

FIG. 8 is an enlarged horizontal crosssectional view taken on line 8—8 of FIG. 1; and FIG. 9 is a fragmentary elevational cross-section showing the upper shaft and push button.

DETAILED DESCRIPTION OF PREFERRED EMBODIMENT

Figure 1:
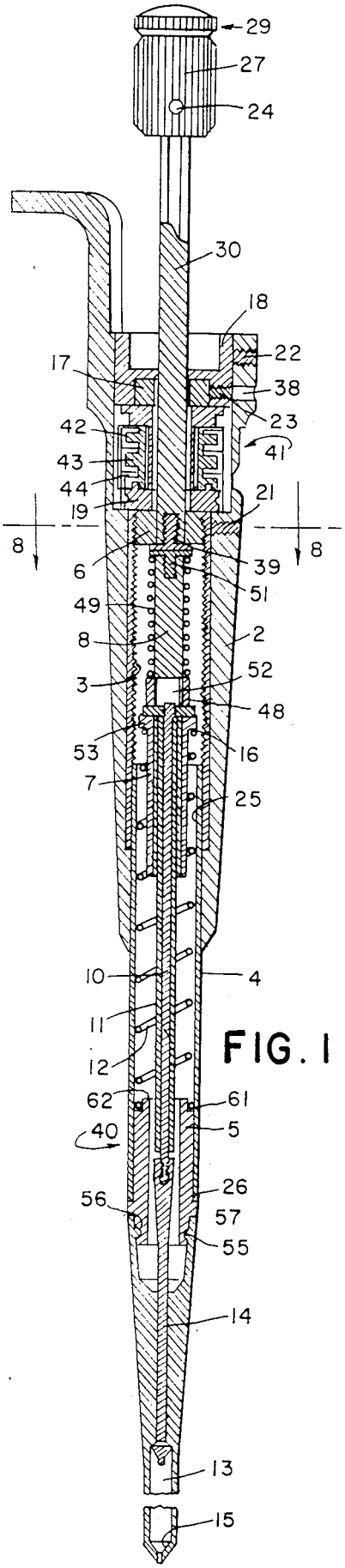
FIG. 1 is a vertical cross-sectional view taken through an improved microdispenser according to the present invention, with a dispensing tip in place and with its plunger rod in released position, corresponding to its position after it has been pressed to install the plunger, and released to fill the tip with the sample material.

Referring now to FIG. 1 of the drawings, a typical embodiment of an improved liquid microdispenser according to the present invention is shown which comprises a main handle 2 housing an internally threaded sleeve 3 axially and longitudinally secured by set screw 21. Bonded to sleeve 3 in an unthreaded lower portion 25 is extension tube 4 in which adapter 5 is secured against abutment 26. Sleeve 3, extension tube 4 and adapter 5 together comprise assembly 40. An adjustable stop bushing 6 is threadedly engaged in sleeve 3. The stop bushing 6 includes a non-circular bore (preferably hexagonal as shown in FIG. 8) and is slidably engaged on a correspondingly configured operating shaft 30.

FIGS. 1 and 7 illustrate a conventional 3-digit counter assembly 41 of internal-pinion type employed in the present invention. Counter assembly 41 includes a mounting bushing 18, numbered display wheels 42, 43, 44, and a drive bushing 19, the counter assembly being secured to handle 2 by a set screw 22 which engages and clamps bushing 18. Drive bushing 19 has a central bore having the same non-circular configuration as the bore of stop bushing 6. The bore of bushing 19 interfits with and is thereby locked rotationally to, shaft 30. Shaft 30 passes unobstructed through circular central apertures provided in bushing 18 and number wheels 42, 43, and 44. The display wheel 44 is the "units" wheel, and is rigidly coaxially secured to drive bushing 19, as for example by means of interlocking pins and grooves.

Secured on the top end portion of shaft 30 by means of set screw 24 is a cup-like bushing 27 having a serrated outer surface. The outer surface of bushing 27 facilitates manual rotation of shaft 30 to adjust the longitudinal position of stop bushing 6 within sleeve 3. Looking at FIG. 9, there is shown a tool 28 embodied within bushing 27. The tool 28 includes a hexagonal shank 44 extending from a hub member 31 depending from a push button disc element 29. The shank 44 is rotatably received in a recess 50 provided therefor in the top portion of shaft 30, and hub 31 is likewise received in a cavity 45 provided therefor in bushing 27. The hub 31 has a peripheral groove 37 which loosely holds a split wire ring fastener 36 which removably secures tool 28 with cavity 45. The hub 31 and it push button disc element 29 are free to rotate when the tool assembly 28 is engaged in the cylindrical counterbore 45 of the bushing 27. Thus, no torque is applied to the bushing 27 when the push button disc element 29 is pressed into or extracted from bushing 27 during the operation of the device, yet the tool assembly 28 is normally retained in the bushing 27 by the frictional force exerted by the split spring-wire ring fastener 36 against the wall of cavity 45 (see U.S. Pat. No. 4,501,163 to MacDermott et al).

Referring again to FIG. 1, a locking bushing 17 is shown slidably and non-rotatably mounted on shaft 30 and retained in a recess in bushing 18. A set screw 23 which may be accessed through an opening 38 (see FIG. 7), is employed to prevent rotation of shaft 30, thus locking the volume adjustment mechanism and the counter display. Set screws 21, 23 and 24 may be tightened or loosened using tool 28, but set screw 22 is designed to be engaged by a different tool (not shown) in order to prevent the user from disturbing or tampering with the volume adjustment mechanism. When adjusting the volume setting (as will be explained below), the set screw 23 is loosened.

Figure 4:
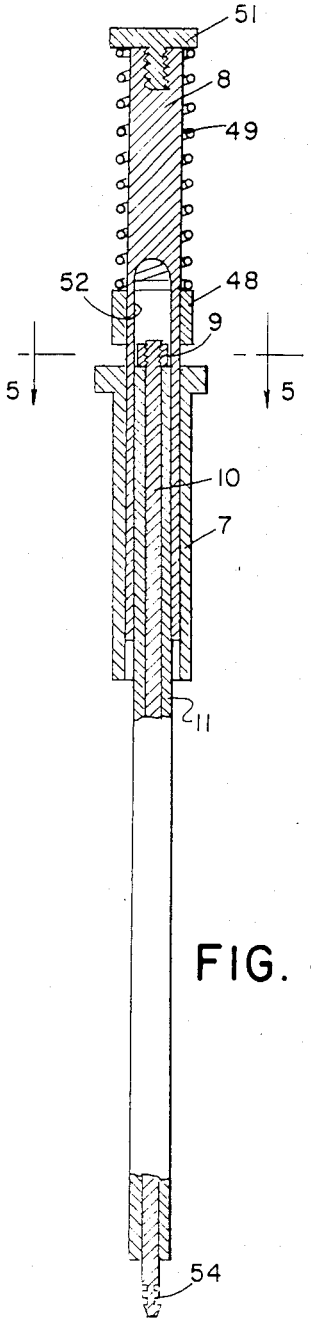
FIG. 4 is an enlarged cross-sectional view showing the internal mechanism by which the plunger and tip are removed, as a unit, from the dispenser.
Figure 5:
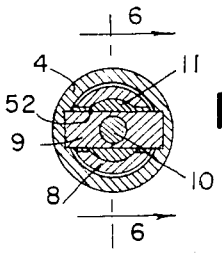
FIG. 5 is a cross-sectional view of the dispenser internal mechanism taken in the direction of section lines 5—5 in FIG. 4.

Stop screw 39 (see FIGS. 1 and 3) is threadedly secured concentrically within the lower end of shaft 30 to lie in abutment with stop bushing 6 and cap screw 51, the latter being threadedly secured concentrically within the upper end of slotted rod 8. (Note: rod 8 and shaft 30 could have been coupled at stop screw 39 and cap screw 51, but this would have required that the entire internal mechanism would be rotated with every volume adjustment. By using two screws, rotation is limited to shaft 30 and space for lubrication is provided in the cup of cap screw 51.) The lower end of rod 8 includes a slot 52 within the lower portion of which is bonded the tube or sheath 11. The tube 11 surrounds rod 10 along substantially its entire length (see FIGS. 4–6 for details). The upper end of rod 10 is threaded and is secured concentrically within, and normal to the longitudinal axis of, a pin 9 which is slidably engaged in slot 52 in the lower end of rod 8. Pin 9 desirably, but not necessarily, is of rectangular cross-section to allow more surface area contact with bushing 7. In so doing, the rate of wear of the pin may be minimized in comparison with the rate of wear of a circular cross-section pin. Rod 10 is afforded a sliding fit inside tube 11, and includes an annular grooved lower portion 54 (see FIGS. 1 and 4) extending beyond the lower end of tube 11. A coiled spring 49 and a bushing 48 are disposed coaxially about rod 8. Spring 49 biases bushing 48 in the direction of, and against pin 9, which projects radially equally from both sides of slot 52. Spring 49 thus biases pin 9 against abutment 53 of slot 52, but constrains the motion of pin 9 in slot 52 to linear motion when spring 49 is compressed.

Figure 2:
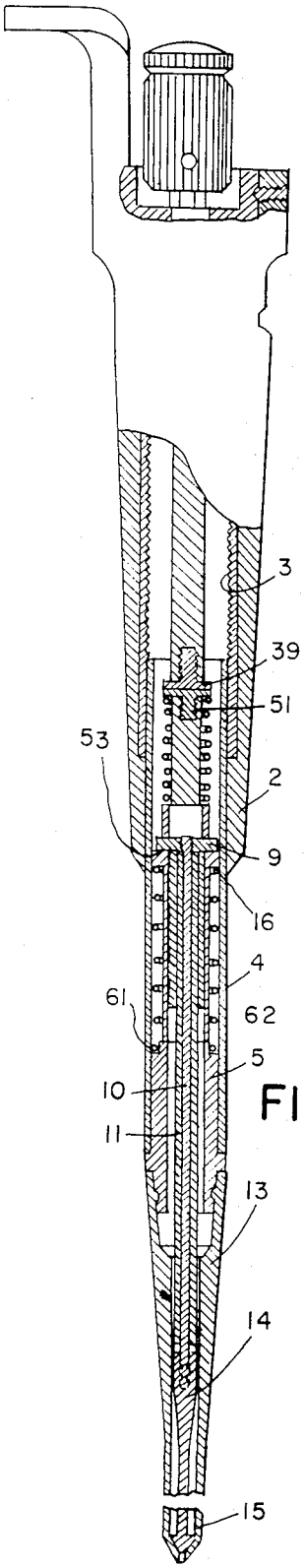
FIG. 2 is an elevational view similar to FIG. 1, partly in vertical cross-section, showing the plunger rod pressed to a discharge position wherein all the sample has been dispensed and the tip and plunger are ready to be discarded.

Surrounding the lower section of rod 10, below pin 9 is a stepped bushing 7. Bushing 7 is slidably disposed within sleeve 3 (see FIGS. 1 and 2) of the assembly 40, and is biased upwardly against the lower face of pin 9 at abutment 53 by coiled spring 12 surrounding tube 11 and the lower portion of bushing 7. Biasing of bushing 7 occurs due to compression of the spring 12 between abutment 16 of bushing 7 at one end, and abutment 61 of bushing 5 at the opposite end. The biasing of bushing 7 against pin 9 thus results in screw 51 being urged against stop screw 39 via biasing spring 49. Spring 12 therefore, albeit indirectly, biases stop screw 39 against stop bushing 6.

Figure 3:
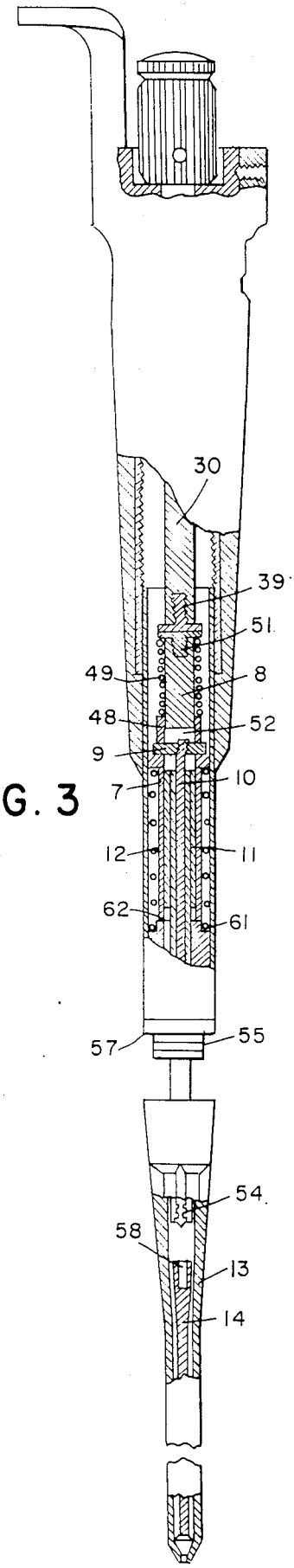
FIG. 3 is an elevational view, similar to FIG. 1 and FIG. 2, partly in vertical cross-section, showing the plunger rod pressed beyond the point where the sample has been discharged and where the dispensing tip and plunger have been forced off the dispenser.

In normal operation, a pipet tip 13 and plunger 14 are installed by first pressing adapter bushing 5 into the resilient conical end of pipet tip 13 so that the annular ring 56 carried internally of the upper end of pipet tip 13 is engaged in the external annular groove 55 of bushing 5. Pipet tip 13 is thereby securely located on bushing 5 against abutment 57. Manual depression of push button 29 relative to handle 2 forces rod 10 toward the top of plunger 14 (which, for purposes of installation of the pipet to the handle, is located in the lower portion of pipet tip 13), and after rod 10 engages plunger 14, the plunger is pressed firmly against abutment 15. Continued depression of push button 29 forces annular rings 54 on the lower end of rod 10 into resilient recess 58 provided in the upper end of plunger 14 at which time bushing 7 abuts shoulder 62 of bushing 5 (see FIG. 3) against the biasing force established within compressed spring 12 (FIG. 3). In this way, the lower end of rod 10 engages in recess 58 of plunger 14 coupling rod 10 to plunger 14 in a secure, yet removable, manner.

Once coupling is completed, the pipet tip 13 is lowered into a liquid supply receptacle, whereupon push button 29 is released allowing the coiled, biasing spring 12 to move plunger 14 upwardly so that the pipet tip 13 is filled by suction. The pipet is then conveyed to a receiving receptacle, and a metered quantity of liquid is dispensed by depressing push button 29 until the lower end of bushing 7 again abuts bushing 5. The filling and dispensing cycle may be repeated as often as desired.

Continued depression of the push button 29 after the liquid has been dispensed causes stop screw 39 to push against cap screw 51 and compress spring 49 thereby allowing rod 8 to slide past pin 9 (inside slot 52) so that tube 11 slides downwardly over rod 10. Tube 11 then abuts against the end of plunger 14 forcing it downwardly whereupon rod 10 is uncoupled from recess 58 whereupon the plunger is uncoupled from the lower end of rod 10. At the same time, pipet tip 13 is uncoupled from its snap-fit engagement on bushing 5 by the downward motion of plunger 14, in front of tube 11, against abutment 15 (FIG. 3).

The upward travel of the plunger 14 may be adjusted from a position corresponding to zero delivery (wherein plunger 14 engages abutment 15 in the lower end of pipet tip 13, and bushing 7 abuts bushing 5 at shoulder 62) to a position corresponding to maximum delivery (wherein plunger 14 is located at the upper end of the precision bore of pipet tip 13). This is accomplished by advancing the bushing 6 upon rotation of shaft 30 relative to handle 2; when so doing, the numbers on the counter wheels 42, 43, 44 corresponding to the adjusted intake volume will appear in window 59 in handle 2.

Calibration of the instrument is accomplished by advancing the bushing 6 to the minimum (zero) volume position whereby bushing 7 just abuts bushing 5. In this position, all the counter wheels should be aligned at the zero values, or at a predetermined value near zero, (e.g. at "999" for an equivalent reading of "−1" or at "001" for an equivalent reading of "+1"). To make any adjustments necessary to align the zero values of the counter wheels, set screw 21 is loosened using tool 28 to allow rotation of assembly 40 within handle 2. Assembly 40 is rotated by rotating the extension tube 25 while holding handle 2. Shaft 30 will rotate the "units" wheel 44 via drive bushing 19 until the desired zero reading of all the wheels is attained. Set screw 21 is then retightened to lock in the calibration. No tip is required for calibration, nor is there need for an external calibration gauge. The proper calibration for each volume between minimum and maximum is assured by the precision thread of sleeve 3 which provides for displacement of piston 14 from the abutment 15 by the exact distance necessary to correlate with the reading of the counter.

Having thus described the present invention, the features which distinguish the instant pipet from dispensing pipets typically known should now be clear to persons of ordinary skill in this art. For example, in contrast to the prior art discussed above, the present invention provides for calibration of each pipet tip to zero volume during its installation. This is accomplished by the engagement of rod 10 with piston 14 only as far as has been previously determined as the point of zero volume when the plunger 14 has been forced to the bottom 15 of tip 13. This allows for the combined length of the rod 10 and the plunger 14 to be precisely that amount required to urge plunger 14 into abutment against pipet rip 13 at its bottom 15 when the bushing 7 abuts bushing 5 at shoulder 62.

In other words, when the piston mechanism has been depressed to the travel stop (bushing 5) which corresponds to zero volume, the rod 10 will have been urged into piston 14 only to that distance necessary to insure that piston 14 is abutting the bottom 15 of the pipet tip 13 (zero volume in the pipet). If the length of the pipet tip 13 varies slightly from other tips, the rod will be pressed downwardly a respectively varied amount to insure that zero-volume is always attained at zero stroke. This feature can only be obtained with the present invention, since neither the d'Autry, nor the Satchell et al, structure provides for a pipet that can be calibrated at any volume to the tip and plunger combination without compromising accuracy in molding tolerances.

The volume adjustment and calibration mechanism of the invention as described above is additionally novel in this art to the extent that it permits calibration of the piston stroke in the field and at the time of use to match the counter reading for a variety of volumes. Pipet tips which are employed normally will shrink longitudinally when sterilized by steam autoclave, due to the nature of the plastic used in the manufacture. The resulting length change can only be accounted for by using the rod and piston combination provided by the present invention. In contrast, the prior art does not allow for such a change in length and therefore dispensing errors are likely to occur. In fact, it is interesting to note that even the d'Autry patent does not recommend that the pipets be autoclaved.

Novelty also lies in the feature of the present invention in connection with the ability of the pipet to dispense any volume with the maximum volume rating of the tip while providing for an ejectable plunger-tip combination that can be automatically and precisely calibrated to the minor differences in tip length. This feature is manifested in the mechanism that interrelates the rod 10 and tube 11 with pin 9 allowing for extension tube 11 beyond the rod 10 by depressing the operating shaft beyond the stop at bushing 5.

Yet another novel feature of the present invention is the automatic reduction of error, at a "zero" setting, to substantially zero. This error (a theoretical limit of zero) is actually the standard deviation of the tip volume and is a function of the tip orifice size. The larger the orifice the more the corresponding fluid meniscus can vary from one dispensing maneuver to another. While some prior art tips have orifices almost as large as the bore, the present invention contemplates use of orifices of 0.025" diameter on a bore of 0.113 diameter which allows for a standard deviation from one dispensing to the next dispensing of 0.5 μl or less. At lower volumes the error is under 0.2 microliters (0.0002 grams)). This feature provides for maximum accuracy at minimum volumes where accuracy is more critical as a percentage of the dispensed volume. Other devices known in the art have their minimum error at full volume and hence their maximum error at minimum volume. This is due to the nature of the adjustment means utilized by calibrated thread devices. The calibrated thread pitch is an approximation, to the nearest thousandth of an inch, of the motion required to vary the volume in the pipet tip by an appropriate amount equal to the change in counter reading that occurs when the operating shaft is rotated one full revolution (360°). Due to molding parameters of the mating pipet tip, there has typically always been a minor error in matching the volume change created by the thread to the volume reading of the counter. When the pipet is calibrated at full volume, the maximum accumulated error will occur at the minimum volume. The error is equal to the pitch error times the number of revolutions required to make the adjustment from the maximum volume to the minimum volume. Volume error is conventionally stated as a percentage of the desired volume. Thus the allowable error percentage (generally desired to be one percent or less) requires a greater absolute volume accuracy at small volumes than at larger volumes.

Various modifications within the spirit of the present invention may occur to those skilled in the art. It is intended that such modifications should be comprehended within the meaning and range of equivalents of the disclosed embodiment.

What is claimed is:

1. A pipet for dispensing liquids comprising:

a handle having upper and lower ends, a longitudinal axis and a bore extending therethrough along said axis;

an operating shaft coaxially supported in the upper end of said handle for reciprocable sliding movement in said bore;

rod means supported coaxially within said bore and extending from an upper region of said bore to a lower region of said bore said rod means being supported for reciprocable movement along said handle axis and comprising upper rod means and lower rod means supported longitudinally within said upper rod means, said lower rod means being slidably engaged with said upper rod means;

a dispensing tip including an upper end and a lower dispensing end, said dispensing tip having conduit means interconnecting said two ends;

a piston supported for reciprocable movement in said conduit means;

first means extending from said handle lower end, for coupling said dispensing tip upper end to said handle lower end;

second means, carried by said rod means, for coupling said piston with said operating shaft; and means, slidably carried within said handle, for uncoupling said dispensing tip from said handle and said piston from said rod means, said uncoupling means including means for extending said upper rod means over said lower rod means to disconnect said piston from said rod means, whereby said handle and said dispensing tip may be separated from one another.

2. The pipet of claim 1, wherein said extending means is slidably housed within said uncoupling means.

3. The pipet of claim 1, wherein said extending means comprises means in a lower end of the upper rod means, for slidably receiving an upper end of said lower rod means; and said coupling means comprises:

bushing means, housing said rod means and first resilient means for urging said rod means upwardly within said bushing means, said lower rod means uspporting thereabout a tube of predetermined length extending from the lower end of said bushing means, said tube and said lower rod means being relatively movable;

means, located in said handle lower end, for limiting downward sliding of said bushing means; and second resilient means, disposed within said handle lower end between said limiting means and said bushing means, for normally urging said bushing means upwardly;

whereby when said operating shaft is moved downwardly with said rod means in said handle bore, said bushing means is moved downwardly until the bushing means lower end contacts said limiting means, whereupon further movement downwardly of said operating shaft in said bore, the lower end of said tube moves said plunger away from said second coupling means and as said second coupling means is released from said plunger, said upper rod means moves relative to said lower rod means and said receiving means receives the upper end of said lower rod means.

4. The pipet of claim 3, wherein said receiving means comprises a slot, and the upper end of said rod means lower section has secured thereto pin means configured for sliding engagement in said slot.

5. The pipet of claim 1, wherein said piston is reciprocable, within said conduit means, between a first position in which the dispensing volume of said conduit means is substantially zero, and a second position in which the dispensing volume in said conduit means maximized, and said handle includes means for predetermining the extent of travel of said piston from said first position to said second position, whereby the dispensing volume in the conduit means of any dispensing tip may be preselected.

6. The pipet of claim 5, and further including means, housed within said handle upper end, for indicating the preselected volume.

7. The pipet of claim 6, wherein said operating shaft is rotatably supported in said handle upper end, and said indicating means is operatively connected to, and for rotation with, said operating shaft.

8. The pipet of claim 7, wherein said operating shaft has a cross-section of non-circular configuration, and said handle upper end includes a drive bushing secured to a portion of said indicating means, said drive bushing including means, having said operating shaft configuration, for selectively engaging said operating shaft, said operating shaft and said indicating means defining means for calibrating said indicating means to a setting corresponding to said plunger first position.

9. The pipet of claim 1, wherein said uncoupling means is moved at least downwardly within said bore by downward movement of said operating shaft in said bore.

10. The pipet of claim 1, wherein said uncoupling means comprises:

bushing means, housing said rod means and first resilient means for urging said rod means upwardly within said bushing means, said lower rod means supporting thereabout a tube of predetermined length extending from the lower end of said bushing means, said tube and said lower rod means being relatively movable;

means, located in said handle lower end, for limiting downward sliding of said bushing means; and second resilient means, disposed within said handle lower end between said limiting means and said bushing means, for normally urging said bushing means upwardly;

whereby when said operating shaft is moved downwardly with said rod means in said handle bore, said bushing means is moved downwardly until the bushing means lower end contacts said limiting means, whereupon further movement downwardly of said operating shaft in said bore, the lower end of said tube moves said plunger away from said second coupling means and as said second coupling means is released from said plunger, said upper rod means moves relative to said lower rod means and said receiving means receives the upper end of said lower rod means.

* * * * *